US007303433B1

(12) United States Patent
Scholeno et al.

(10) Patent No.: US 7,303,433 B1
(45) Date of Patent: Dec. 4, 2007

(54) LAMP SOCKET FOR HIGH WATTAGE LAMPS

(75) Inventors: Michael Scholeno, York, PA (US); Michael Swantner, Saxonburg, PA (US); Shane Brown, York, PA (US); Randall Gillotti, Warren, PA (US)

(73) Assignee: Osram Sylvanis Inc., Danvers, MA (US)

( * ) Notice: Subject to any disclaimer, the term of this patent is extended or adjusted under 35 U.S.C. 154(b) by 0 days.

(21) Appl. No.: 11/499,420

(22) Filed: Aug. 4, 2006

(51) Int. Cl.
*H01R 24/00* (2006.01)

(52) U.S. Cl. ..... 439/552

(58) Field of Classification Search ..... 439/699.2, 439/242, 243, 414, 336, 441, 437; 362/306, 362/296, 226; 313/318.01
See application file for complete search history.

(56) References Cited

U.S. PATENT DOCUMENTS 3,689,870 A * 9/1972 Jaconette ..... 439/752
4,647,132 A * 3/1987 Mikola ..... 439/345
5,120,239 A * 6/1992 Witek, Jr. ..... 439/349
5,120,242 A * 6/1992 Greiler et al. ..... 439/683
6,039,597 A * 3/2000 Getselis et al. ..... 439/441
6,168,282 B1 * 1/2001 Chien ..... 362/84

* cited by examiner

*Primary Examiner*—Alexander Gilman
(74) *Attorney, Agent, or Firm*—William E Meyer

(57) ABSTRACT

A zero insertion force socket for a lamp. The lamp socket (10) for a high wattage lamp (12) having lamp pins (14, 16), comprises a substantially solid, parallelepipedonal electrically insulating body (18), preferably of a ceramic material, having two side walls (20, 22), two end walls (24, 26) and a top (28) and a bottom (30) with first and second electrical contact receiving sections (32, 34) formed in the top (28). First and second contact reception areas (34, 36), respectively, are formed in each of the first and second electrical contact receiving sections. An electrical contact (38), is positioned in each of the contact reception areas (34, 36), and each of the electrical contacts (38) has a lamp pin receiver (40) with arms (42, 44). Means (46), for example, a threaded member (58) such as a bolt, is provided for constricting the arms to grasp the lamp pins after insertion into the socket. The threaded member (58) has a freely-rotatable head (58*a*) positioned in arm (44) and a threaded end (58*b*) engaging a threaded aperture (58*c*) in arm 42.

6 Claims, 4 Drawing Sheets

LAMP SOCKET FOR HIGH WATTAGE LAMPS

TECHNICAL FIELD

This application relates to lamp sockets and more particularly for lamp sockets for high wattage lamps.

BACKGROUND ART

High wattage lamps, that is, those lamps having power ratings above 10,000 watts, are relatively massive and usually have a bi-pin base. The pins usually comprise copper or brass rod or tubing up to ½ inches (12.7 mm) in diameter and can be several inches (50-75 mm) long. Such pins can generate considerable frictional force when inserted into a conventional socket.

DISCLOSURE OF INVENTION

It is, therefore, an object of the invention to obviate the disadvantages of the prior art.

It is another object of the invention to enhance high wattage lamp sockets.

Yet another object of the invention is the provision of a lamp socket having a zero insertion force with a high normal force on the lamp pin.

These objects are accomplished, in one aspect of the invention, by a lamp socket for a high wattage lamp having lamp pins, said socket comprising: a substantially solid, parallelepipedonal electrically insulating body having two side walls, two end walls and a top and a bottom with first and second electrical contact receiving sections formed in said top; first and second contact reception area formed in each of said first and second electrical contact receiving sections; an electrical contact positioned in each of said contact reception areas, each of said electrical contacts having a lamp pin receiver with a pair of arms; means for constricting said arms to grasp said lamp pins; a wire receiving aperture formed in one of said arms of each electrical contact; means formed in each of said side walls for receiving a wire; means for securing a wire inserted into said wire receiving aperture formed in said one of said arms; an air gap formed between said first and second electrical contact receiving sections; and an aperture formed in each of said side walls for gaining access to said means for constricting said arms.

The use of the constricting means allows for a zero insertion force on the pins as they enter the socket and a strong normal force on the pins after the constricting means is actuated.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
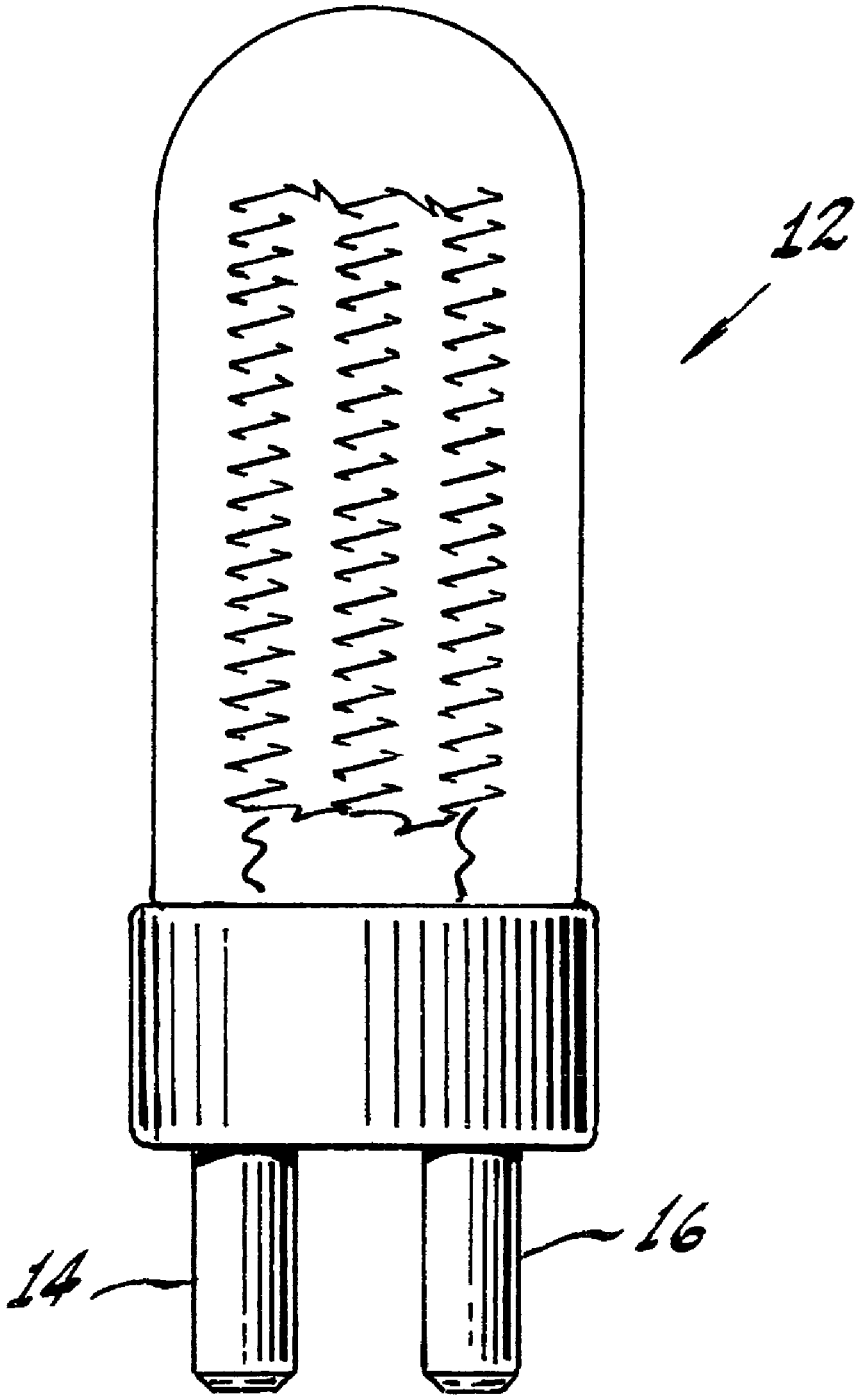
FIG. 1 is a diagrammatic, elevation view of a lamp usable with the invention.

Referring now to the drawings with greater particularity, there is shown in FIG. 1 a high wattage lamp 12 having a bi-pin base having lamp pins 14, 16. The lamp pins are electrically conductive material such as brass or copper and, for this particular lamp, have a diameter of about ½ inch (12.7 mm). The pins can be solid rod or tubular, depending upon the application.

Figure 2:
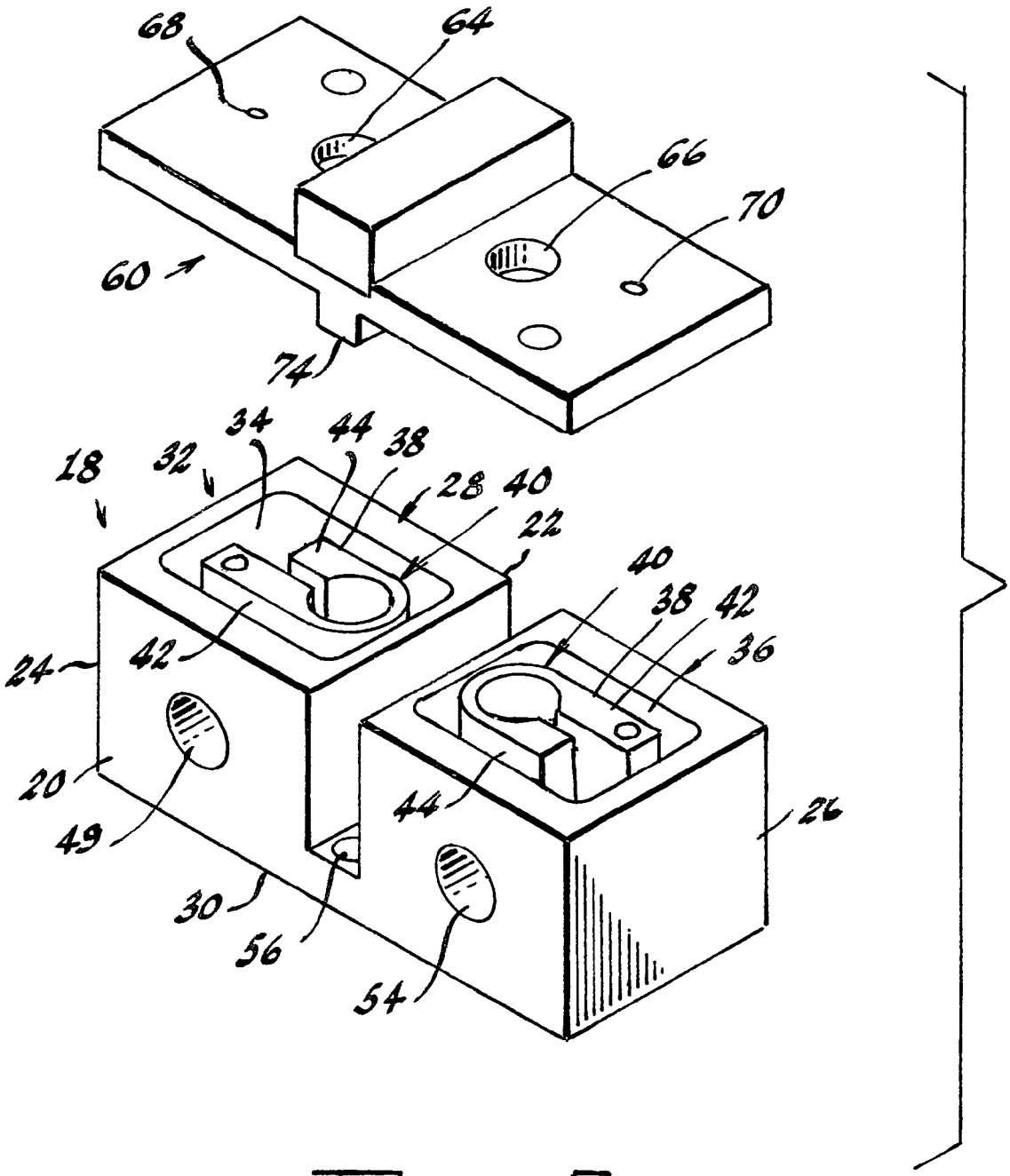
FIG. 2 is an exploded, perspective view of an embodiment of the invention.

A zero insertion force socket for this lamp is shown in FIG. 2. Therein, a lamp socket 10 for a high wattage lamp 12 having lamp pins 14, 16, comprises a substantially solid, parallelepipedonal electrically insulating body 18, preferably of a ceramic material, having two side walls 20, 22, two end walls 24, 26 and a top 28 and a bottom 30 with first and second electrical contact receiving sections 32, 34 formed in the top 28. First and second contact reception areas 35, 36, respectively, are formed in each of the first and second electrical contact receiving sections.

Figure 3:
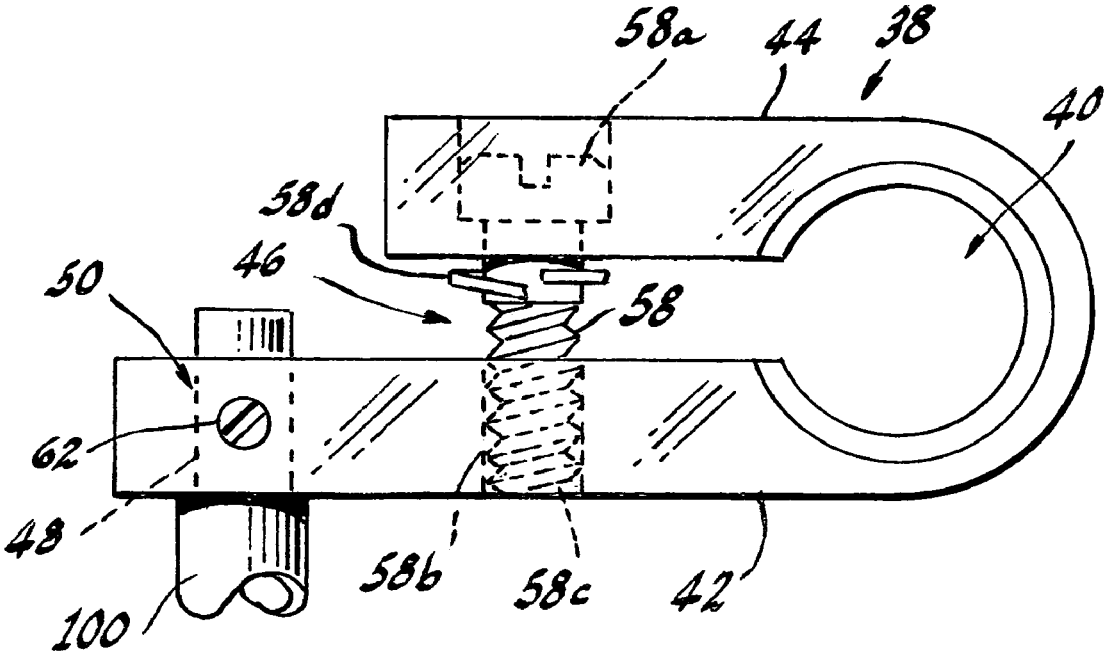
FIG. 3 is a plan view of an embodiment of a contact usable with the invention.

An electrical contact 38, shown more clearly in FIG. 3, is positioned in each of the contact reception areas 35, 36, and each of the electrical contacts 38 has a lamp pin receiver 40 with arms 42, 44. Means 46, for example, a threaded member 58 such as a bolt, is provided for constricting the arms to grasp the lamp pins after insertion into the socket. The threaded member 58 has a freely-rotatable head 58*a* positioned in arm 44 and a threaded end 58*b* engaging a threaded aperture 58*c* in arm 42.

A wire receiving aperture 48 is formed in one of the arms of each electrical contact 38, for example, arm 42, and means 49 in the form of an entrance aperture is formed in the side walls 20, 22 for receiving a wire 100 and communicating with the wire receiving aperture 48. Means 50, for example, a setscrew 62, for securing a wire inserted into the wire-receiving aperture 48 is provided in the arm 42 in a direction substantially normal to the axis of aperture 48.

Figure 4:
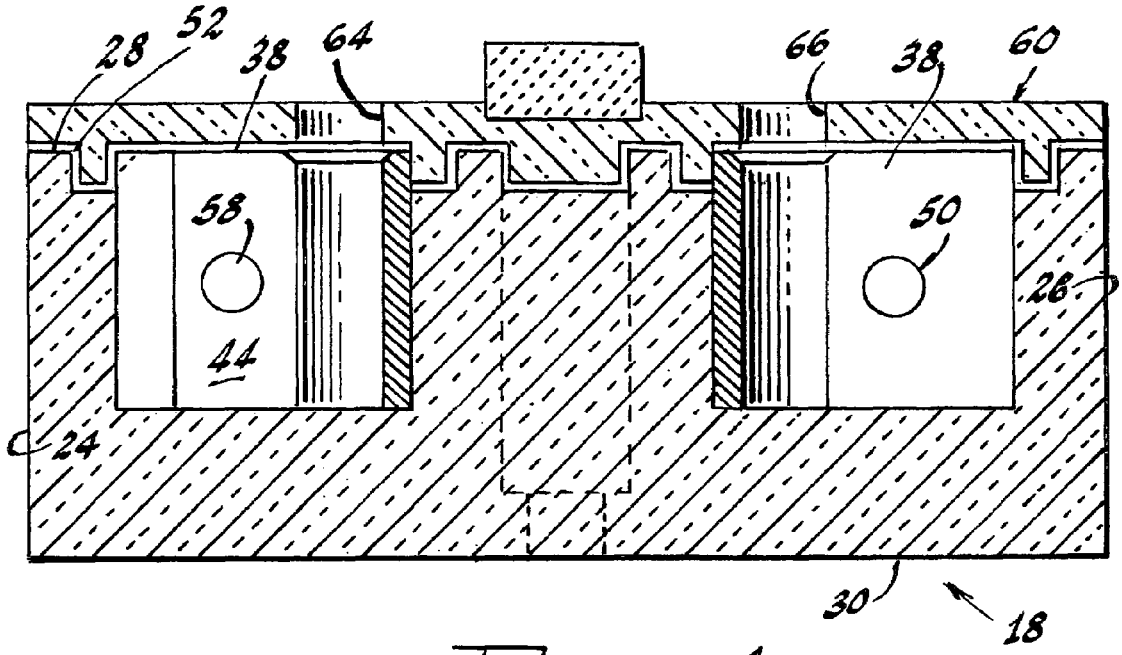
FIG. 4 is a sectional view through the center of a socket with a cover in place.
Figure 5:
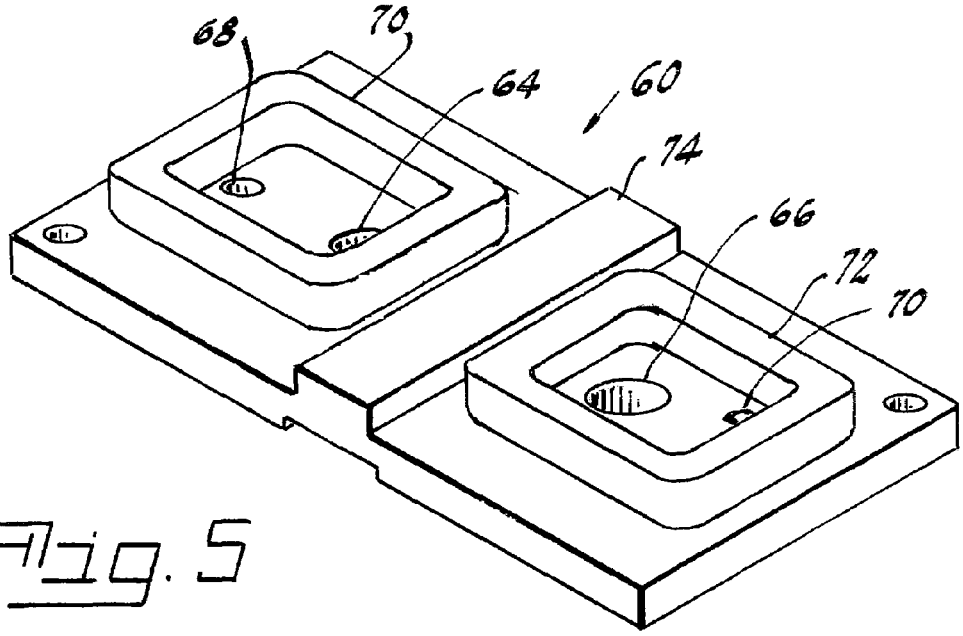
FIG. 5 is a perspective view of the inside of a cover.

An air gap 52, shown diagrammatically as a double line in FIG. 4, is formed between the first and second electrical contact receiving sections to reduce the possibility of arcing through the air between the lamp pins 14, 16. The lengthened air gap is provided by the bosses 70, 72 formed on the underside of the cover 60, and the protrusion 74 that divides the socket into two sections.

An aperture 54 is formed in each of the side walls 20, 22 for gaining access to bolt head 58*a* for constricting the arms 42, 44 to secure the lamp pins 14 and 16 into the socket. A retaining ring 58*d* surrounds the threaded member 58 and aids in separating the arms 42, 44 when it is necessary to remove the lamp 12.

The insulating body 18 contains means 56 for engaging the socket 10 with a foundation such as a wall or ceiling and can be in the form of an aperture for receiving a screw, bolt or other fastening device.

The cover 60, which also preferably is of a ceramic material, contains apertures 64, 66 for receiving the lamp pins 14, 16 therein and additionally contains apertures 68, 68, for accessing the setscrew 62 to fix the wire 100 in place.

The cover 60 can also be provided with a central groove 102 to receive a key 104 that separates the lamp pins 14 and 16 when the lamp 12 is inserted into the socket.

There is thus provided a rugged socket for a high wattage lamp that provides a zero insertion force for the relatively massive lamp pins and high normal force when the arms 42, 44 of the contact 38 are constricted.

While there have been shown and described what are present considered to be the preferred embodiments of the invention, it will be apparent to those skilled in the art that various changes and modifications can be made herein without departing from the scope of the invention as defined by the appended claims.

What is claimed is:

1. A lamp socket for a high wattage lamp having lamp pins, said socket comprising:

a substantially solid, parallelepipedonal electrically insulating body having two side walls, two end walls and a top and a bottom with first and second electrical contact receiving sections formed in said top; said insulating body containing means for engaging said socket with a foundation;

first and second contact reception area formed in each of said first and second electrical contact receiving sections;

an electrical contact positioned in each of said contact reception areas, each of said electrical contacts having a lamp pin receiver with a pair of arms;

means comprising a threaded member for constricting said arms to grasp said lamp pins;

a wire-receiving aperture formed in one of said arms of each electrical contact;

means formed in each of said side walls for receiving a wire;

means for securing a wire inserted into said wire receiving aperture formed in said one of said arms;

an air gap formed between said first and second electrical contact receiving sections; and an aperture formed in each of said side walls for gaining access to said means for constricting said arms.

2. The lamp socket of claim 1 wherein said means for securing said wire in said one of said arms comprises a second treaded member.

3. The lamp socket of claim 1 wherein said electrically insulating body is ceramic.

4. The lamp socket of claim 1 wherein said threaded member is surrounded by a retaining ring.

5. The lamp socket of claim 1 wherein an electrically insulating cover is mounted upon said electrically insulating body, said cover having apertures for receiving said lamp pins.

6. The lamp socket of claim 5 wherein said electrically insulating cover contains apertures for accessing said second threaded member.

* * * * *